US005879204A

United States Patent [19]

Delarue et al.

[11] Patent Number: 5,879,204

[45] Date of Patent: Mar. 9, 1999

[54] RESILIENT CONNECTOR HAVING AN INSERTABLE STOP MEMBER

[75] Inventors: Bernhard Delarue, Bensheim; Friedrich Schmidt; Gerhard Huiskamp, both of Lage; Heike Neumann, Rödermark; Jörg Diekmann, Oerlinghausen; Klaus Endres, Maintal; Manfred Lange, Königstein; Rainer Schulze, Detmold; Ralf Beller, Holte-Stukenbrock; Werner Radde, Bassenhausen, all of Germany

[73] Assignee: Weidmüller Interface GmbH & Co., Detmold, Germany

[21] Appl. No.: 841,808

[22] Filed: May 5, 1997

[30] Foreign Application Priority Data

May 6, 1996 [DE] Germany ..... 296 08 178.7

[51] Int. Cl.[6] ..... H01R 4/48

[52] U.S. Cl. ..... 439/835; 439/828

[58] Field of Search ..... 439/715, 789, 439/786, 828, 829, 835

[56] References Cited

U.S. PATENT DOCUMENTS 4,940,431 7/1990 Hennemann ..... 439/715

FOREIGN PATENT DOCUMENTS 29514509.9 7/1995 Germany ..... H01R 4/48

295 14509 12/1995 Germany .

*Primary Examiner*—Neil Abrams
*Assistant Examiner*—Jean F. Duverne
*Attorney, Agent, or Firm*—Laubscher & Laubscher

[57] ABSTRACT

A resilient connector for maintaining an electrical conductor in side-by-side conductive engagement with a bus bar includes a generally loop- or O-shaped resilient contact body having a first end portion, an intermediate portion arranged generally normal to the intermediate portion, and a second end portion that is normally arranged at an acute angle relative to the contact intermediate portion, the contact first end portion containing a window opening having first and second opposed edges remote from and adjacent the intermediate portion, respectively, the second contact end portion being displaceable from a normal first position adjacent the first window edge toward a second position adjacent the second window edge, whereby when the second contact end is displaced to its second position and a conductor and a bus bar are introduced in side-by-side electrically conductive relation within the window, release of the second end portion causes the conductor and the bus bar to be clamped in tight electrical contact by the cooperation between the second contact end portion and by the first window edge. In order to prevent permanent distortion of the contact body, a stop member is mounted within the contact cavity for limiting movement of the second contact end beyond the second position. Consequently, the stop member permits the use of the contact arrangement in fixed pole applications where the bus bar and the compression spring are to be installed from above or below a housing within which the electrical components are contained.

21 Claims, 8 Drawing Sheets

FIG. 3a
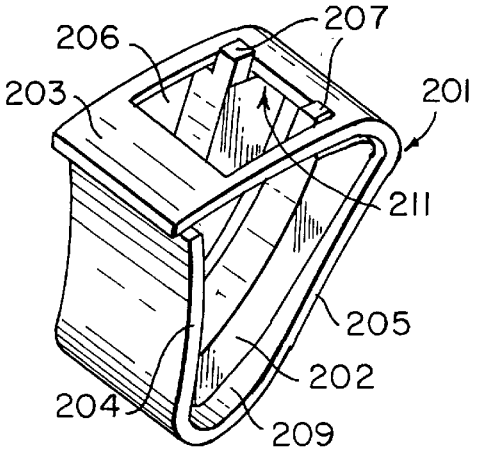
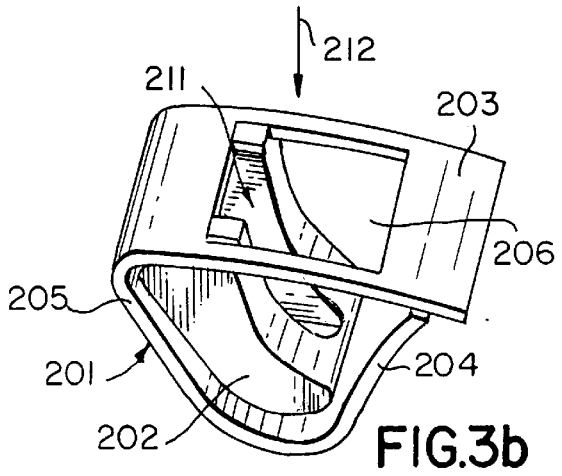
FIG.3b
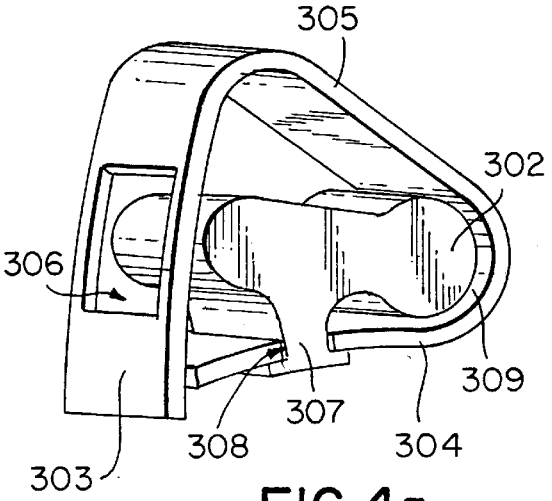
FIG. 4a
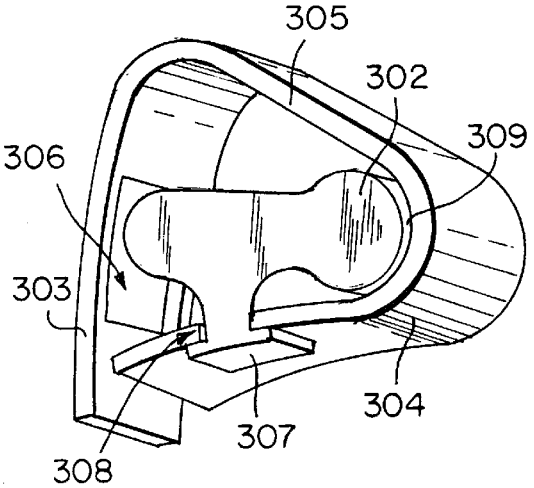
FIG. 4b
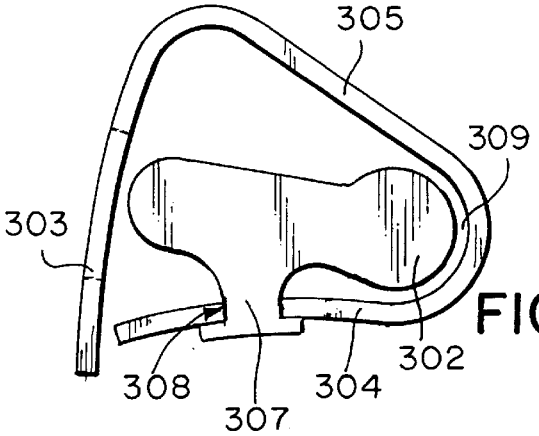
FIG.4c
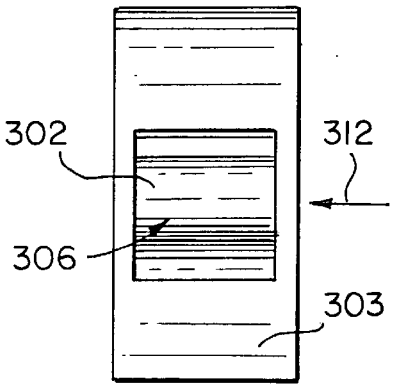
FIG. 4d

RESILIENT CONNECTOR HAVING AN INSERTABLE STOP MEMBER

BACKGROUND OF THE INVENTION

1. Field of the Invention

A resilient connector is provided for maintaining an electrical conductor in side-by-side conductive engagement with a bus bar, including a generally loop- or O-shaped contact body having a first end portion, an intermediate portion arranged generally orthogonally relative to the first end portion, and a second end portion arranged at an acute angle relative to the intermediate portion, the contact first end portion containing a window opening and the second contact end portion being bendable from a first position adjacent a first edge of the window remote from the intermediate portion to a second position adjacent a second window edge adjacent the intermediate portion, thereby to permit introduction within the window of the conductor and the bus bar in side-by-side electrically conductive relation, characterized by the provision of a stop member within the contact body to prevent deformation of the second contact end portion beyond the second position.

2. Brief Description of the Prior Art

It is known in the patented prior art to provide resilient connectors for maintaining an electrical conductor in electrically-conductive side-by-side relation with a bus bar, the connector having a generally loop- or O-shaped contact body having a first end portion arranged generally normal to an intermediate portion, and a second end portion arranged at an acute angle relative to the intermediate portion, the first end portion containing a window opening for receiving the conductor and the bus bar. The second end portion normally biases the conductor and the bus bar toward the edge of the window that is remote from the intermediate portion. An example of such a resilient connector is presented by the German Gebrauchsmuster No. DE-GE 295 14 509 U 1 published Dec. 12, 1995. Such resilient connectors are particularly useful in connection with so-called terminal blocktype arrangements wherein a plurality of synthetic plastic blocks are assembled to form a multiple connecting block. In this arrangement, a previously assembled subassembly including a bus bar and a resilient compression member is inserted laterally into a given housing. In this arrangement, there is no problem in preventing excessive stressing and permanent deformation of the resilient connector. To this end, the previously assembled bus bar and resilient connector assembly is maintained on s stop cam that is arranged on the plastic housing and that comes to rest inside the loop-shaped bent spring and limits the resilient travel of the movable spring portion relative to the overall dimensions of the component.

The aforementioned stop means cannot be used with fixed-pole housings having resilient connections for electrical connectors. The significance of such fixed-pole housings increases particularly in the area of high pole numbers and, simultaneously, very low grid intervals for reasons of production engineering, technical function and installation. Here it is impossible to insert protective means for preventing overstretch deformation, as in the case of the aforementioned terminal block type, because the bus bar and the resilient connector must normally be inserted from above or from below the housing chamber, and in the process a synthetic plastic cam or the like cannot be inserted that protrudes into the interior or the loop- or O-shaped contact.

In the aforementioned German Gebrauchsmuster No. 295 14 509 U !, a stop portion is formed on one of the movable resilient connector portions, or on the bus bar itself, thereby to limit the extent of resilient travel in the opening direction. One problem associated with such stop means is that complex machining or metalworking techniques are required to produce the stop extensions on the contact parts or on the bus bar, and complicated tools are required for their manufacture. Furthermore, it is difficult to assemble the sheet metal parts, owing to their shapes and the various assembly possibilities.

The present invention was developed to avoid the above and other drawbacks of the known types of resilient connectors, and to provide an improved resilient connector assembly that will positively prevent deformation through over-stressing of the moveable parts of the connector, together with simple assembly procedures and at a reasonable cost.

SUMMARY OF THE INVENTION

Accordingly, a primary object of the present invention is to provide an improved resilient connector including a removable stop member that is inserted within an O- or loop-shaped resilient contact body, thereby to limit the extent of over stress movement of the component and to prevent the permanent deformation thereof.

A more specific object of the invention is to provide a resilient connector wherein a separate stop member is inserted within the cavity contained within the O-shaped contact body through either a window contained in a first resilient contact leg, or laterally into the chamber within the contact body for connection with one or more portions thereof.

For this purpose, the stop element—which can have various outside contours whose shape is also reminiscent of the known stop cams of the aforementioned terminal block type—is inserted as an individual component or as a component that is to be rendered individual into the interior of the loop-shaped, bent resilient contact. Here, there is a possibility of inserting the stop element through a window of the resilient contact that is oriented in the direction of insertion of the conductor; in this way, particularly in case of a resilient contact and bus bar assembly that has already been inserted in a housing, one can subsequently insert the stop element. Moreover, it is possible to equip a previously assembled assembly of bus bar and resilient contact—prior to insertion in a fitting housing—with a stop element that is inserted through the two lateral openings of the loop-shaped, bent area of the resilient contact and that is arranged in the housing together with the previously assembled assembly of the bus bar and the resilient contact. Also, a stop element can be inserted in the resilient contact, and this previously assembled assembly can be mounted on the bus bar. The structural unit thus completed can then be arranged as a whole in the housing. Here, it is particularly important to fix the stop element on the resilient contact or the bus bar by means of suitable measures such that one can reliably prevent the stop element from falling out of the inside of the resilient contact in connection with any possibly additionally necessary handling procedures. By separating the stop element and the resilient contact or the bus bar, along with the economic advantages of simplified assembly, it becomes possible, in particular, to use resilient contacts with suitable stop limitations also in connection with fixed-pole housings with small grid intervals and a large number of poles. It is also possible by the use of synthetic plastic materials for the stop elements as well as the attendant finishing possibilities to achieve a reasonably priced and extensively automatable prefabrication of the resilient contact, according to the invention.

According to a preferred embodiment of the invention, the stop element is so fixed on the resilient contact that the stop element in the loop-shaped bent area in the segment opposite the window will be placed at preferably an equal interval from the resilient contact. In this way, one can make certain that when the resilient contact is bent, for example, upon the insertion of an electrical conductor into the window, the loop-shaped, bent area of the contact can be deformed without coming to rest against the stop element. This, in turn, makes it possible to ensure that the contact end portion comes to rest against the stop element in an area through which runs the line of application of the activation force. This leads to a particularly secure protection of the contact. By means of such a stop, the stressing force, for example, from an activation tool, is kept away from critical area of the extension spring, thereby to prevent the permanent deformation thereof.

In another preferred embodiment, the stop element is located at least in subsegments inside on the loop-shaped, bent area of the resilient contact. In this way, one can influence the resilient properties of the contact by suitably fashioning and placing the contact surfaces.

To secure the position or to establish the captive condition of the stop element, the latter can be fixed on the resilient contact in a force-locking and/or form-locking manner. Here, the fixation is so made that it can be locked in a preferred embodiment. As another advantageous design, the stop element is fixed upon the boundary edges of the window of the resilient contact. Here, one can, in particular, also so change the shape of the window of the resilient contact that one can achieve form-locking or force-locking attachments of subordinate parts of the stop element. In another preferred embodiment, the stop element is fixed on the area of the resilient contact that is associated with the bus bar. Another embodiment provides that the stop element be fixed in a force-locking manner due to the spring action of the resilient contact itself in the interior of that element. This time, the stop element is preferably firmly braced in terms of its longitudinal extent upon the prestressed contact element and is therefore held in a force-locking manner due to spring action so that there is no need to provide fixing elements.

A preferred embodiment with respect to the shape of the stop element is such that the stop element is essentially rigid and that as far as its outside contour is concerned, that is be made to fit in the shape of a bond within the loop-shaped, bent contour of the resilient contact. Here, in particular, a massive area is provided on the end of the stop element that is associated with the loop-shaped, bent area of the resilient contact; this massive area is separated by a narrower area from the once again massively made area near the window of the extension spring. In this way, one gets a shape for the stop element that is reminiscent of the shape of a bone.

Another embodiment of the stop element consists essentially of V-shaped sides where the stop element, as regards its outside contour, is adapted to the loop-shaped, bent contour of the resilient contact and where the V-shaped sides of the stop element are elastically deformable as the resilient contact is activated. Along with the previously described support of the spring action of the resilient contact, one can thus achieve that owing to the spring action of the contact, the stop element is likewise securely retained in the interior area of the contact, the stop element is likewise securely retained in the interior area of the extension spring without the need for providing any molded elements for positioning purposes.

Regarding the assembly of the components, looking at another advantageous embodiment, the stop element—with the resilient contact in a non-prestressed condition—is inserted into the interior of the loop-shaped, bent area. In another embodiment, the contact is prestressed by the bus bar during the assembly of the stop element, and the stop element is inserted into this prestressed contact.

Various possibilities can be visualized for the assembly of the stop element so as to prepare the stop element favorably in terms of handling. One embodiment shows that the stop element can be held in readiness individually as an injection molded part, or that it can be arranged on retaining belts. Another embodiment consists of the fact that the stop element can be held in readiness as part of an endless injection molding belt where, for the purpose of assembly at required fracture points, the individual stop elements are separated from an endless injection molding belt and are supplied to the assembly point. The stop element can also be provided as continuous casting section piece that is cut off from this continuous casting section piece of proper length only for assembly with corresponding dimension. In another embodiment, the stop element can be inserted in a non-stressed resilient contact that is placed in an injection molding tool.

According to another feature of the invention, another solution of the problem where the job is done by means of a resilient connector, according to the invention, having a stop element made integrally with the surrounding wall areas of a fixed-pole housing and which protrudes through the window into the loop-shaped, enclosed interior space of the resilient connector or which can be inserted therein. With these embodiments, it is possible to reduce a minimum the still necessary handling procedures for inserting the stop elements. For this purpose, for example, a stop element is so provided in an integral fashion in a wall area of the fixed-pole housing that is associated with the window of the resilient contact that it will be connected with a wall area via a narrow bridge that after functionally correct association of wall area and resilient contact will pass through the window of the contact and will thus position the stop element inside the contact.

A particularly advantageous design provides for the insertion of the stop element by means of the association, for example, of a wall area belonging to the lid part of the housing, this happening of necessity as the lid is closed.

BRIEF DESCRIPTION OF THE DRAWINGS

Other objects and advantages of the invention will become apparent from a study of the following specification when viewed in the light of the accompanying drawings, in which:

FIGS. 3*a* and 3*b* are perspective views of opposite sides of a third embodiment of the invention;

FIGS. 4*a* and 4*b* are side and bottom perspective views, respectively, of a fourth embodiment of the invention, and FIGS. 4*c* and 4*d* are right side and front views, respectively, of the embodiment of FIGS. 4*a* and 4*b;*

DETAILED DESCRIPTION

Figure 1A:
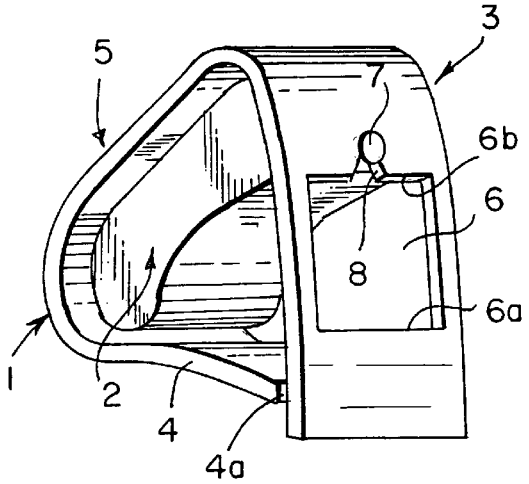
FIGS. 1*a* and 1*b* are front and rear perspective views, respectively, of a first embodiment of the resilient connector of the present invention.
Figure 1B:
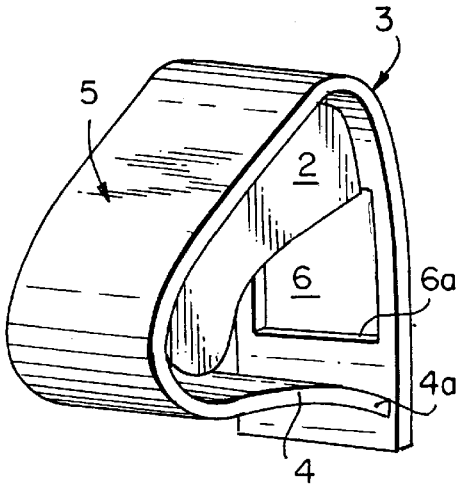

Referring first more particularly to FIGS. 1*a*–1*e*, the resilient connector 1 of the present invention includes a resilient contact body having a first end portion 3, an intermediate portion 5 arranged or orthogonally to the first end portion 3, and a second end portion 4 arranged at an acute angle relative to the intermediate portion 5, as shown. Mounted within the generally O-shaped or loop-shaped contact body is a stop member 2 that is formed of a suitable synthetic plastic insulating material. Contained within the first arm 3 of the resilient contact body is a window opening 6 having parallel opposed first and second edges 6*a* and 6*b* remote from and adjacent the intermediate portion 5, respectively. The second end portion 4 of the contact body—which is formed of a suitable resilient material such a spring steel—is bendable from a first position in which the extremity of the second end portion 4*a* is adjacent to the first window edge 6*a* to a second position in which the extremity 4*a* is adjacent to the upper second window edge 6*b*. In accordance with the characterizing feature of the present invention, movement of the second contact end portion 4 beyond the second position is prevented by the bone-shaped stop member 2. In order to prevent lateral displacement of the stop member relative to the resilient contact body, the stop member is provided at one end with a longitudinal projection 7 that extends through and is locked within a V-shaped recess 8 formed in the second window edge 6*b*.

Figure 1C:
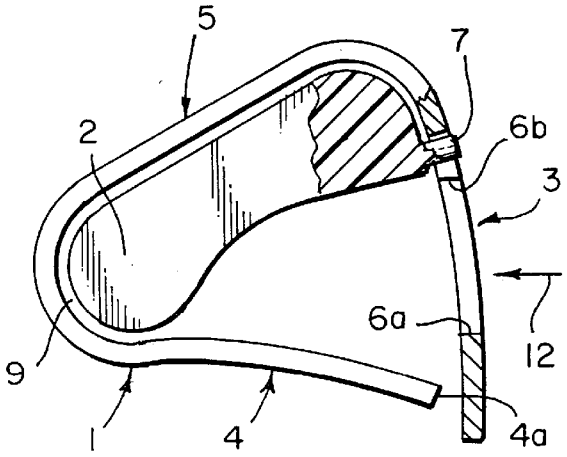
FIGS. 1*c* and 1*d* are side and front elevation views, respectively, of the resilient connector of FIG. 1.
Figure 1D:
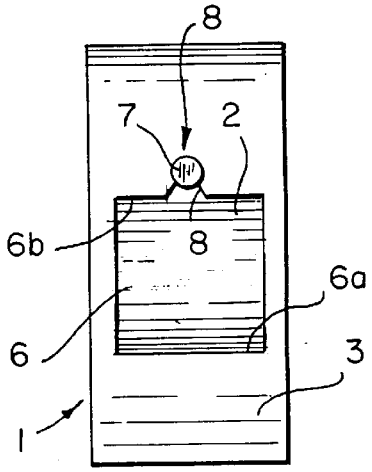
Figure 1E:
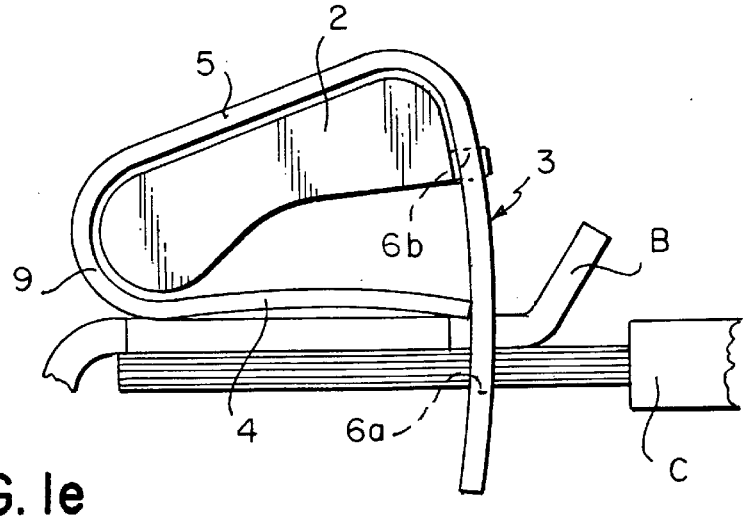
FIG. 1*e* is a side elevation view of the insulated conductor and the bus bar clamped together in side-by-side conductive relation by the resilient connector of FIGS. 1 and 2.
Figure 2A:
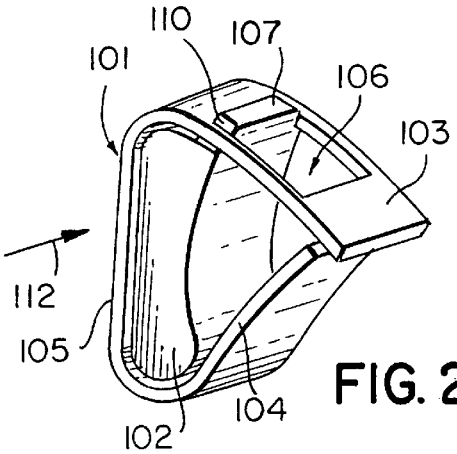
FIGS. 2*a* and 2*b* are perspective views of a second embodiment of the invention.
Figure 2B:
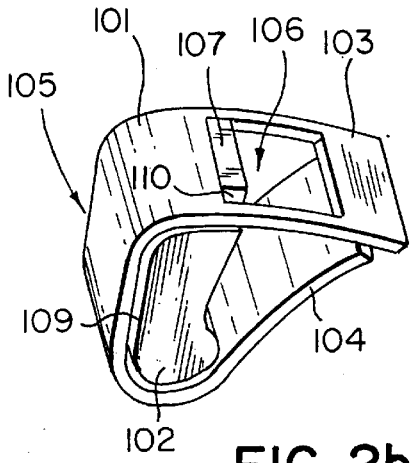
Figure 2C:
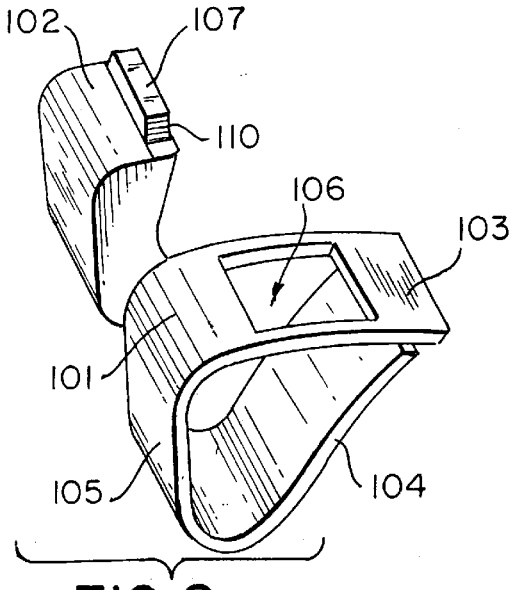
FIG. 2*c* is a perspective view with the stop member removed.
Figure 2D:
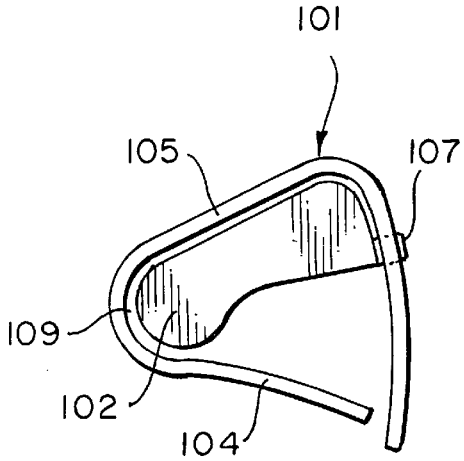
FIG. 2*d* is a side elevation view of the resilient connector of FIGS. 2*a* and 2*b;*
Figure 5A:
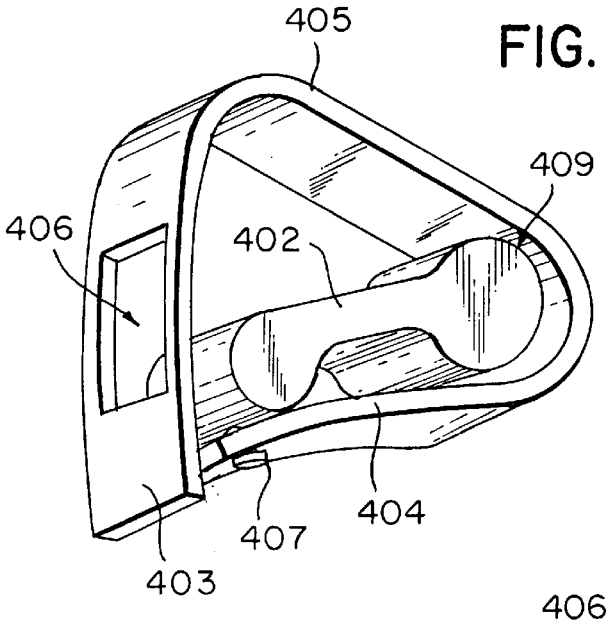
FIGS. 5*a*–5*d* are side perspective, bottom perspective, right side and front views, respectively, of a fifth embodiment of the invention.
Figure 5B:
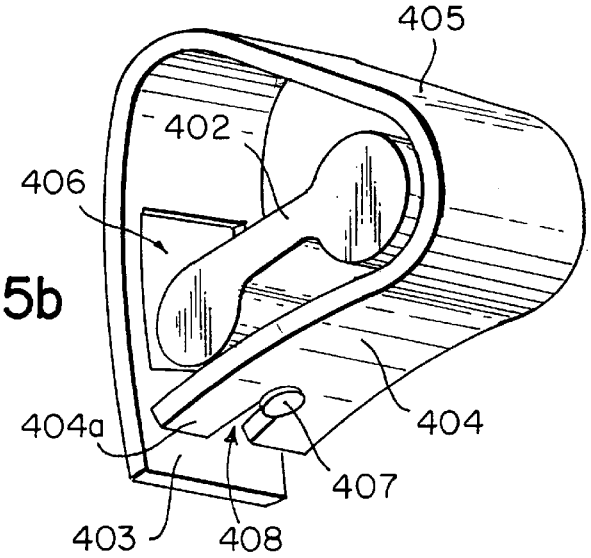
Figure 5C:
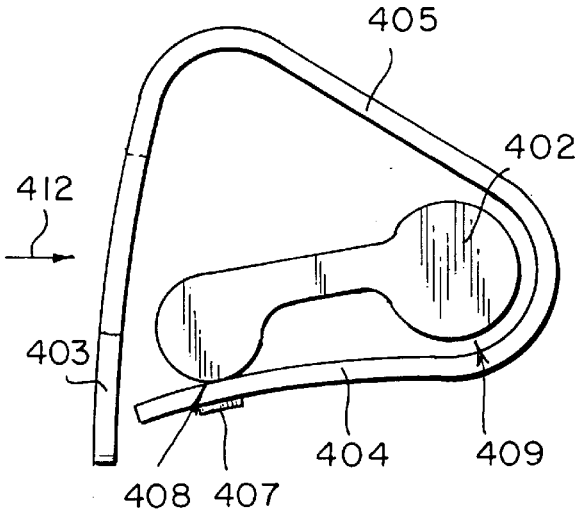
Figure 5D:
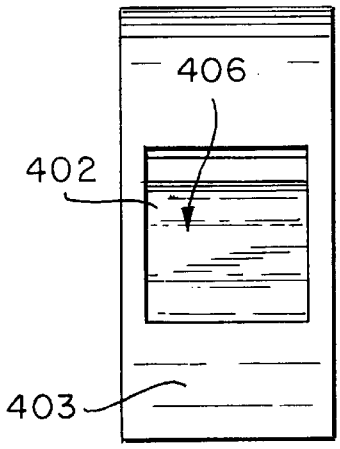

In operation, when the second end portion is bent upwardly to the second position with the end extremity 4*a* adjacent the second window edge 6*b*, the bare portion of the conductor C and bus bar B are inserted in electrically-conductive side-by-side relation within the window opening 6. The stressed end portion 4 is released, whereupon it returns by spring action toward its initial first position, thereby clamping the bus bar 6 and the bare portion of the insulated conductor C against the first edge 6*a* of the window 6. It should be noted that owing to the connection between the pin-type projection 7 and the V-shaped groove or slot 8, the stop member 2 is maintained in uniformly spaced relation relative to the internal surface of the resilient contact body, thereby to define a uniform gap 9 as shown in FIGS. 1*c* and 1*e*. The dimensions of the stop member 2 relative to the window opening 6 are such as to permit insertion of the stop member within the cavity defined within the resilient contact member via window opening 6, as shown by the direction arrow 12.

Referring now to the modification shown in FIGS. 2*a*–2*d*, the stop member 102 includes a generally rectangular projection 107 having remote sidewalls 110 that slidingly engage the side edges of the window opening 106 contained in the first end portion 103 of the resilient contact body 101 which also includes intermediate portion 105 and second end portion 104. Thus, lateral displacement of the stop member 102 relative to the resilient contact body is prevented by the cooperation between the sidewalls 110 of the projection 107 and the corresponding side edges of the window 106. In this embodiment, the stop member 102 is inserted laterally within the cavity defined within the resilient contact body, as indicated by the direction arrow 112. Again, the stop member 102 is supported within the contact body by the cooperation between the projection 107 and the window 106 to maintain the stop body in spaced relation to the internal surface of the contact body to define the uniform gap 109.

Referring shown to the modification shown in FIGS. 3*a* and 3*b*, the stop member 202 is longitudinally split at one end to define a V-shaped slot 211 that extends between a pair resilent of leg portions 207 the extremities of which extend through the window opening 206 contained in the contact body first end portion 203. The contact body also includes an intermediate portion 205 and a second end portion 204, a space 209 being defined between the other end of the stop member and the intermediate contact portion 205. Owing to the longitudional slit 211, the leg portions 207 of the stop member can be displaced together to simplify the insertion of the stop member 202 within the cavity of the resilient contact member via the opening 206 as shown by the direction arrow 212. Upon release of the resilient leg portions 207, they are resiliently displaced apart toward engagement with the sidewalls of the window opening 206, thereby to retain the stop member 202 within the resilient contact body 201 and to form the gap 209. As before, the contact body has an intermediate portion 205 and a pair of leg portions 203 and 204.

Referring now to FIGS. 4*a*–4*d*, the stop member 302 is connected with the second contact portion 304 of the contact member by means of lateral projection 307 that extends through slot 308 contained in the side edge of second contact portion 304. The first contact portion 303 which contains the window opening 306 is connected by the intermediate contact portion 305 with the second contact portion 304. The periphery of the stop member 302 is spaced from the internal surface of the resilient contact member by a uniform gap 309. In this embodiment, the stop member 302 is inserted within the cavity of the loop- or O-shaped contact member in the lateral direction indicated by the arrow 312 (FIG. 4*d*).

In the modification shown in FIGS. 5*a*–5*d*, the stop member 402 is similarly connected with the second contact end portion 404 by means of the lateral projection 407 that extends within slot 408 contained in the end extremity 404*a* of the second end portion of the contact. (FIGS. 5*c* and 5*d*), and is mounted to define a gap 409 between the end of the end of the stop member 402 and the adjacent junction between the first and intermediate contact portions. In this embodiment, the stop member 402 is introduced within the cavity contained within the resilient contact member via window opening 406, as indicated by the direction arrow 412 in FIG. 5*c*. The contact body includes an intermediate portion 405 and a pair of leg portions 403 and 404.

Figure 6A:
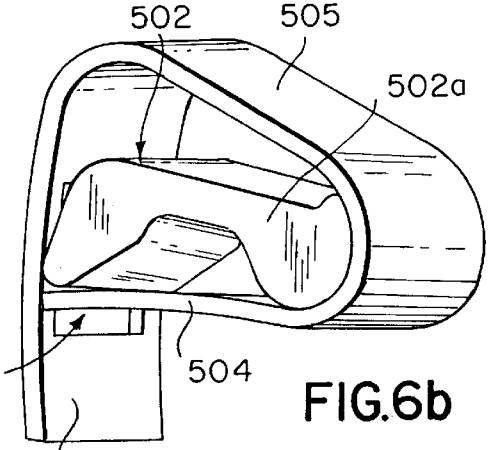
FIGS. 6*a*–6*d* are right perspective, bottom perspective, right elevation and front views, respectively, of a sixth embodiment of the invention.
Figure 6B:
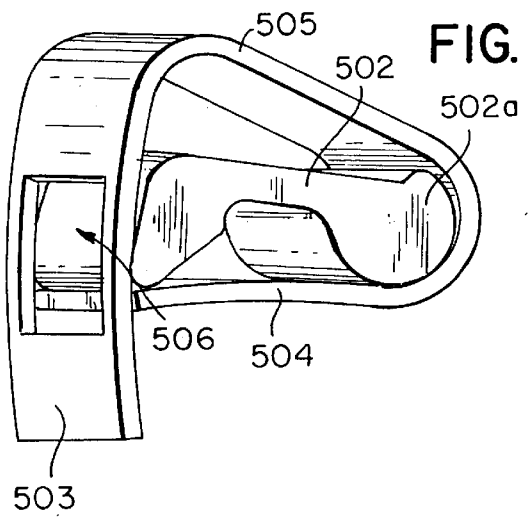
Figure 6D:
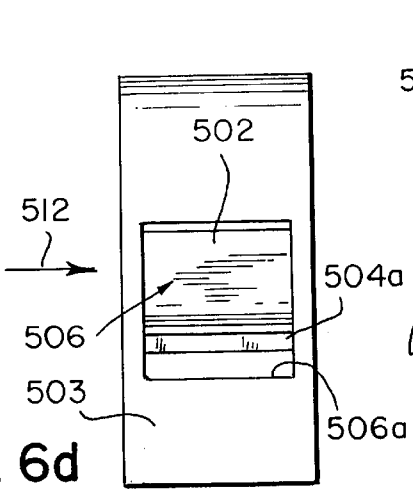
Figure 6C:
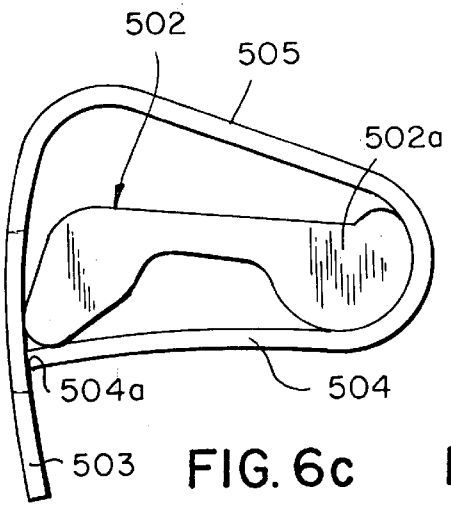
Figure 6E:
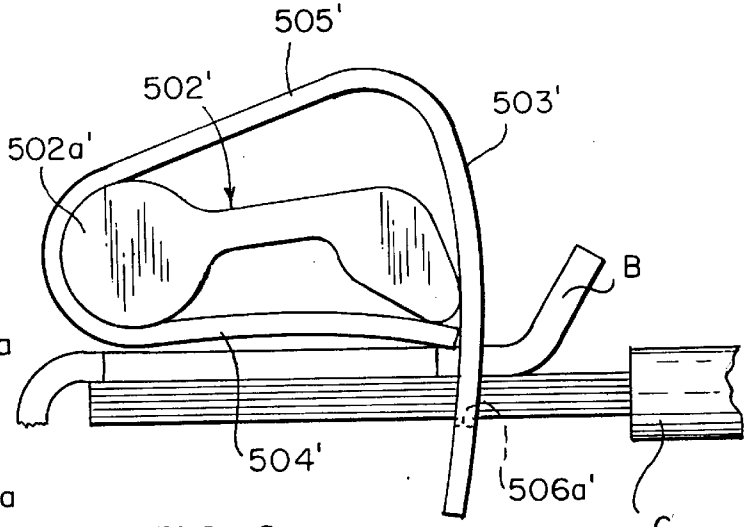
FIG. 6*e* illustrates the conductor and the bus bar clamped together by the resilient connector of FIGS. 6*a* and 6*b;*
Figure 7A:
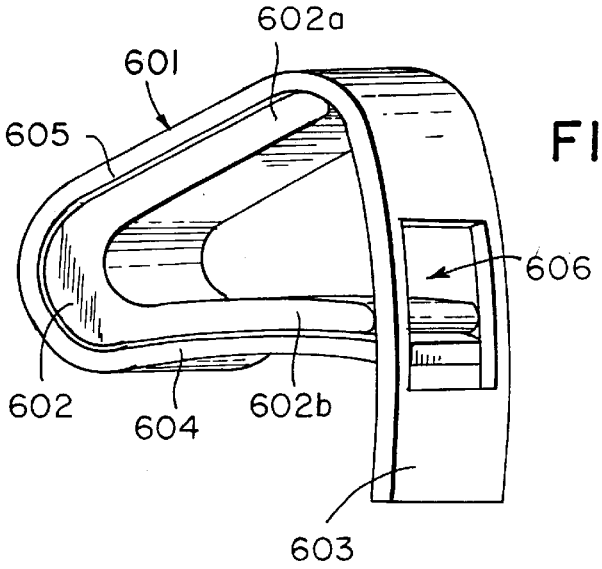
FIGS. 7*a*–7*d* are left perspective, right perspective, left plan and front views, respectively, of a seventh embodiment of the invention.
Figure 7B:
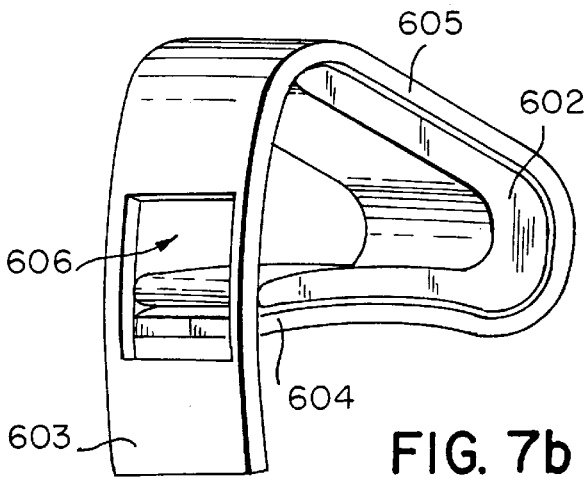
Figure 7C:
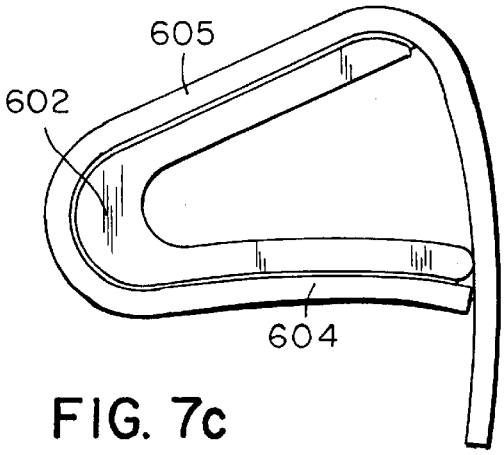
Figure 7D:
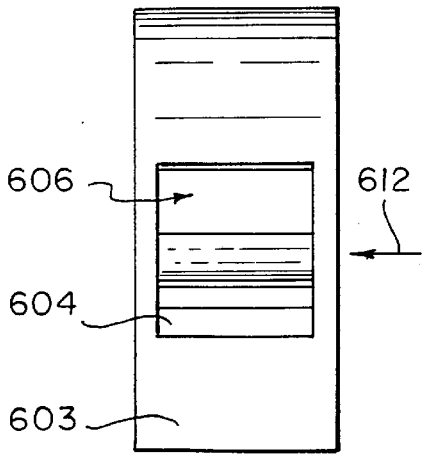
Figure 8A:
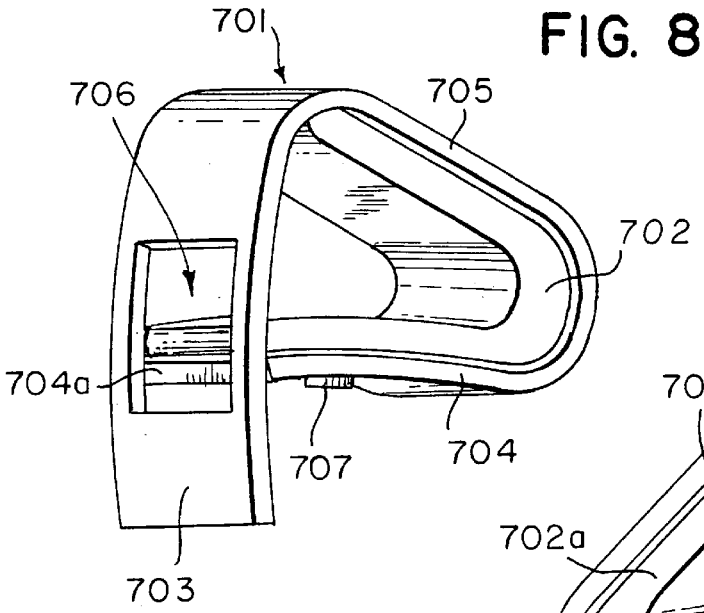
FIGS. 8*a*–8*d* are right perspective, left perspective, left plan and front views, respectively, of an eighth embodiment of the invention.
Figure 8B:
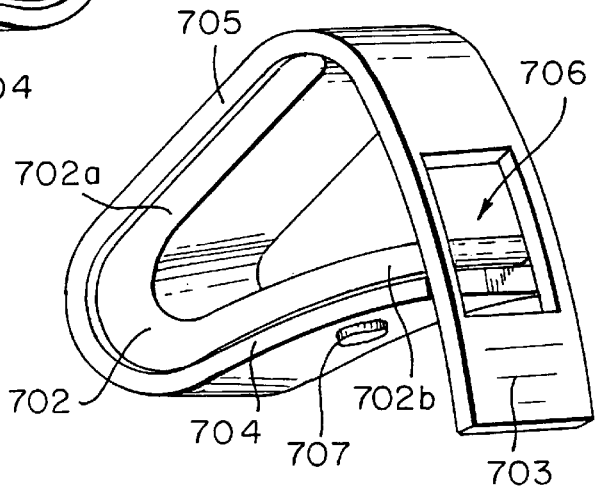
Figure 8C:
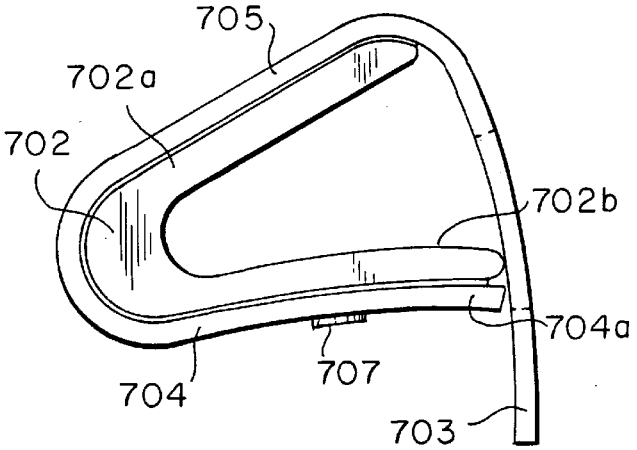
Figure 8D:
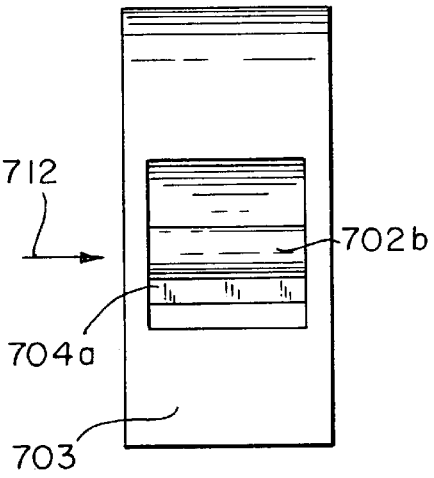

Referring now to the embodiment of FIGS. 6*a*–6*d*, the stop member 502 is retained within the cavity of the resilient contact solely by friction fit, and not with the provision of any pin and slot means as provided in the previous embodiments discussed above. The contact body includes an intermediate portion 505, a leg portion 503 containing window opening 506, and a leg portion 504. In this embodiment, the end portion 502*a* of the stop member adjacent the junction between the second contact end portion 504 and the contact immediate portion 505 is rounded, thereby to prevent a certain degree of rotational movement of the stop member relative to the contact body. The end extremity 504*a* of the second contact portion 504 is normally adjacent the lower edge 506*a* of window 506, as shown in FIG. 6*d*. Similarly, in the modification shown in FIG. 6*e*, the rounded end portion 502*a*' of the stop member 502' has a generally circular outer perifial for rotational displacement of the stop member 502' relative to the resilient contact during the introduction of the bus bar B and the bare wire portion of the conductor C within the window opening contained in the first contact end portion 503' of the resilient contact member having an intermediate portion 505'. In this embodiment, the bus bar B and the bare wire portion of insulated conductor C are clamped in side-by-side electrically-conductive relation against the lower window edge 506*a*' by the resilient second end portion 504' of the contact body. In both embodiments, the stop member is laterally introduced within the cavity of the resilient contact member in the lateral direction shown by the arrow 512 in FIG. 6*d*.

Referring now to the embodiment illustrated in FIGS. 7*a*–7*d*, the stop element 602 is generally V-shaped and includes leg portions 602*a* and 602*b* that extend adjacent to the intermediate portion 605 and the second arm portion 604, respectively, of the resilient contact member 601. In this embodiment, the leg portions 602*a* and 602*b* are displaced together when the bus bar and the electrical contact are introduced within the window opening 606 contained in first contact portion 603. By means of this type of V-shaped stop member 602, one can influence the resilient qualities of the contact member. In this embodiment, a stop member 602 preferably contains in its external surface for receiving a corresponding convex portion of the contact second end portion 604 when the contact second end portion is displaced toward said intermediate portion 605.

According to the modification shown in FIGS. 8*a*–8*d*, the stop member 702 includes a pin-shaped retaining projection 707 that extends through a corresponding opening contained in the second contact end portion 704 and is provided with an enlarged head portion, thereby to fasten the stop member leg 702*b* with the contact second end portion 704. In this embodiment, the stop member 702 is laterally introduced within the cavity as shown by the directional arrow 712, and the pin is inserted within the corresponding opening contained in the contact end 704 whereupon the extremity of the connecting pin is struck to define the enlarged head portion which retains the pin in place. The end extremity 704*a* of leg 704 terminates opposite window 706 contained in leg 703.

Figure 9A:
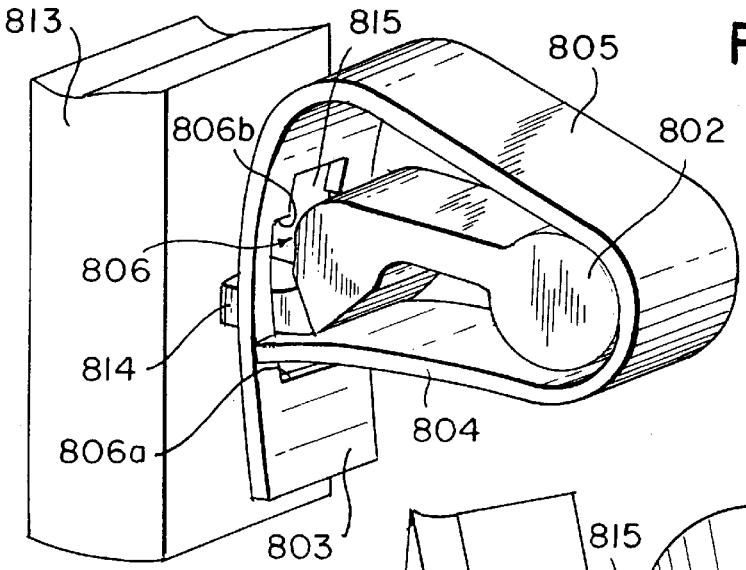
FIGS. 9*a*–9*c* are left perspective, top perspective, and right side elevation views, respectively, of a ninth embodiment of the invention.
Figure 9B:
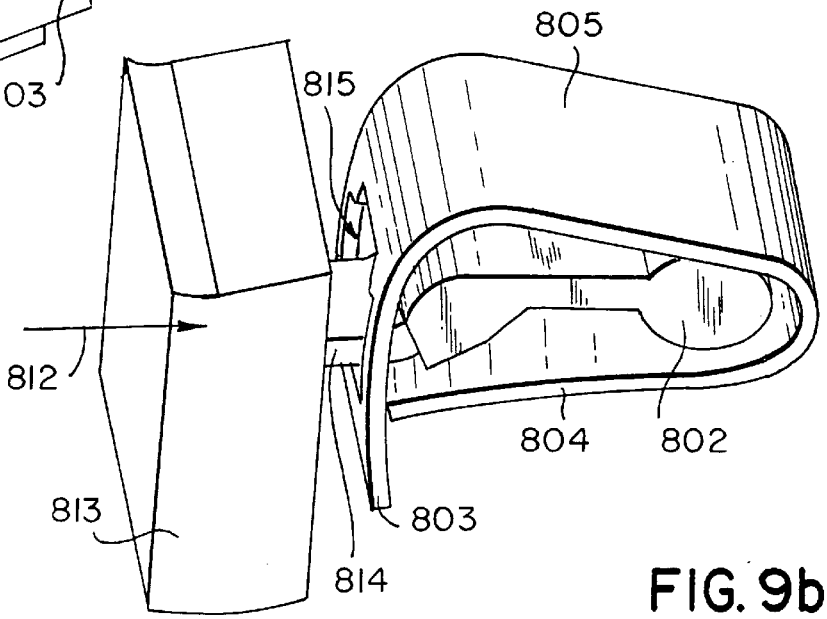
Figure 9C:
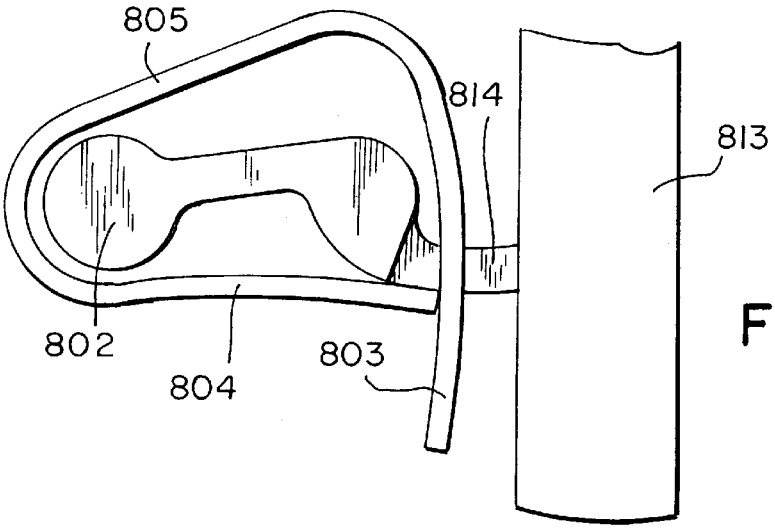

Referring now FIGS. 9*a*–9*c*, the stop member 802 is secured in spaced relation to the housing wall portion 813 by integral bridge means 814. The upper window edge 806*b* of opening 806 formed in first contact portion 803 contains a slot 815 for receiving the bridge portion 814 when the stop member 802 is introduced into the cavity via window opening 806. The contact first and second portions 803 and 804, respectively, are connected by intermediate portion 805. In this manner, a snap connection is provided which permits the use of the closing motion of an element (such as a lid) for assembling the components. The resilient contact could be preassembled with the bus bar and the electrical connector before insertion of the stop member within the cavity of the resilient contact. The window 806 has a lower edge 806*a*.

Preferably, the contact member of the resilient connector assembly is formed of resilient spring steel, although other metals or synthetic plastic materials could be used as well. The stop member is formed of a suitable insulating synthetic plastic material, such as polyethalyne.

While in accordance with the Patent Statutes the preferred forms and embodiments of the invention have been illustrated and described, it will be apparent to those skilled in the art that changes and modifications may be made without deviating from the invention set forth above.

What is claimed is:

1. A resilient self-contained two-part connector assembly for maintaining a conductor in electrical contact with a bus bar, comprising:

(a) a generally O-shaped resilient metal contact body including a first end portion, an intermediate portion arranged generally at right angles to said first end portion, and a second end portion angularly arranged at an acute angle relative to said intermediate portion, said contact body first end portion containing a window opening having opposed first and second edges remote from and adjacent said intermediate portion, respectively, said second end portion having a free extremity and being bendable from a normal first position in which said free extremity is adjacent said first window edge toward a second position in which said free extremity is adjacent said second window edge, whereby when said second contact end portion is bent to said second position and the bus bar and the conductor are introduced to positions in superposed side-by-side engaged relation in said window opening, upon release of said second contact end portion, the conductor and the bus bar are biased by said second contact end portion toward said first window edge, thereby to maintain the conductor in electrical engagement with the bus bar; and (b) a stop member mounted within and carried solely by said contact body for limiting the movement of said second contact end portion beyond said second position, thereby to prevent permanent deformation of the resilient contact body.

2. A resilient contact as defined in claim 1, and further including means connecting said stop member with said contact body to normally define a uniform gap (9) between the outer periphery of said stop member and the inner periphery of said contact member, said gap extending at least adjacent the juncture between said contact intermediate portion and one of said contact end portions.

3. A resilient connector as defined in claim 1, wherein said contact body end portions are resiliently biased together toward engagement with the remote ends of said stop member (502), thereby to retain said stop member within said contact body.

4. A resilient connector as defined in claim 1, wherein said stop member is rigid and has a configuration defining a concave surface adjacent said contact body second contact end portion, and further wherein said contact body second end portion is generally convex and is arranged to extend within the cavity defined by said concave surface when said second end portion is deformed to said second position.

5. A resilient connector as defined in claim 1, wherein said stop member is insertable within said contact body when said second contact body end portion is in said second position.

6. A resilient connector as defined in claim 1, wherein said stop member is insertable within said contact body via said window opening.

7. A resilient connector as defined in claim 1, wherein said contact body is formed of spring steel.

8. A resilient connector for maintaining a conductor in electrical contact with a bus bar, comprising:

(a) a housing member (813);

(b) a generally O-shaped resilient contact body (801) including a first end portion (803), an intermediate portion (805) arranged generally orthogonally relative to the first end portion, and a second end portion (804) containing a window opening (806) having opposed first (806*a*) and second (806*b*) edges remote from and adjacent said intermediate portion, respectively, said second end portion having a free extremity and being bendable from a normal first position in which said free extremity is adjacent said first window edge toward a second position in which said free extremity is adjacent said second window edge, whereby when said second contact end is deformed to said second position and the bus bar and the conductor are introduced to positions in superposed side-by-side engaged relation in said window opening, upon release of said second contact end, the conductor and the bus bar are biased by said second contact end toward said first window edge, thereby to maintain the conductor in electrical engagement with the bus bar; and (c) stop means connected with said housing for limiting the extent of movement of said second contact end portion in the direction from said first position beyond said second position, thereby to prevent permanent deformation of the second contact portion, said stop means including a stop body member having:

(1) a stop body portion (802) arranged within said contact body; and (2) a bridge portion (814) extending through said window opening, said bridge portion having first and second end portions connected with said stop body portion and with said housing portion, respectively.

9. Apparatus as defined in claim 8, wherein said contact member first end portion (803) is generally parallel with and spaced from the adjacent face of said housing portion.

10. Apparatus as defined in claim 9, wherein at least part of said stop body portion is in engagement with said contact intermediate portion.

11. Apparatus as defined in claim 9, wherein said stop portion has in longitudinal cross-section a generally bone-shaped configuration.

12. Apparatus as defined in claim 9, wherein when said first contact end portion is deformed by the bus bar toward said second position, said stop body portion is insertable within said contact body via said window opening.

13. A resilient connector for maintaining a conductor in electrical contact with a bus bar, comprising:

(a) a generally O-shaped resilient contact body including a first end portion an intermediate portion arranged generally at right angles to said first end portion, and a second end portion angularly arranged relative to said intermediate portion, said contact body first end portion containing a window opening having opposed first and second edges remote from and adjacent said intermediate portion, respectively, said second end portion having a free extremity and being bendable from a normal first position in which said free extremity is adjacent said first window edge toward a second position in which said free extremity is adjacent said second window edge, whereby when said second contact end is bent to said second position and the bus bar and the conductor are introduced to positions in superposed side-by-side engaged relation in said window opening, upon release of said second contact end, the conductor and the bus bar are biased by said second contact end toward said first window edge, thereby to maintain the conductor in electrical engagement with the bus bar; and (b) a stop member mounted within said contact body adjacent said intermediate portion for limiting the movement of said second contact end beyond said second position thereby to prevent permanent deformation of the resilient contact body.

14. A resilient self-contained connector assembly for maintaining a conductor in electrical contact with a bus bar, comprising:

(a) a generally O-shaped resilient metal contact body including a first end portion an intermediate portion arranged generally at right angles to said first end portion, and a second end portion angularly arranged relative to said intermediate portion, said contact body first end portion containing a window opening having opposed first and second edges remote from and adjacent said intermediate portion. Respectively, said second end portion having a free extremity and being bendable from a normal first position in which said free extremity is adjacent said first window edge toward a second position in which said free extremity is adjacent said second window edge, whereby when said second contact end is bent to said second position and the bus bar and the conductor are introduced to positions in superposed side-by-side engaged relation in said window opening, upon release of said second contact end, the conductor and the bus bar are biased by said second contact end toward said first window edge, thereby to maintain the conductor in electrical engagement with the bus bar;

(b) a stop member mounted within and carried solely by said contact body for limiting the movement of said second contact end beyond said second position, thereby to prevent permanent deformation of the resilient contact body; and (c) means for retaining said stop member within said contact body.

15. A resilient connector as defined in claim 14, wherein said retaining means includes connecting means (7, 8) for connecting said stop member with said contact body first end portion adjacent said second window edge.

16. A resilient connector as defined in claim 15, wherein said stop member is loosely arranged within said contact body adjacent said contact intermediate portion.

17. A resilient connector as defined in claim 14, wherein said retaining means includes connecting means on said stop member (307, 407) for connecting said stop member with said second contact body end portion.

18. A resilient connector for maintaining a conductor in electrical contact with a bus bar, comprising:

(a) a generally O-shaped resilient contact body including a first end portion, an intermediate portion arranged generally at right angles to said first end portion, and a second end portion angularly arranged relative to said intermediate portion, said contact body first end portion containing a window opening having opposed first and second edges remote from and adjacent said intermediate portion, respectively, said second end portion having a free extremity and being bendable from a normal first position in which said free extremity is adjacent said first window edge toward a second position in which said free extremity is adjacent said second window edge, whereby when said second contact end is bent to said second position and the bus bar and the conductor are introduced to positions in superposed side-by-side engaged relation in said window opening, upon release of said second contact end, the conductor and the bus bar are biased by said second contact end toward said first window edge, thereby to maintain the conductor in electrical engagement with the bus bar; and (b) a stop member mounted within and carried solely by said contact body adjacent said intermediate portion for limiting the movement of said second contact end beyond said second position, thereby to prevent permanent deformation of the resilient contact body, the end portion of said stop member adjacent said first contact body end portion being bifurcated by a V-shaped slot (211) that defines a pair of resilient leg portions (207) that extend within and are biased laterally apart toward the opposite sides of said window opening.

19. A resilient connector for maintaining a conductor in electrical contact with a bus bar, comprising:

(a) a generally O-shaped resilient contact body including a first end portion, an intermediate portion arranged generally at right angles to said first end portion, and a second end portion angularly arranged relative to said intermediate portion, said contact body first end portion containing a window opening having opposed first and second edges remote from and adjacent said intermediate portion, respectively, said second end portion having a free extremity and being bendable from a normal first position in which said free extremity is adjacent said first window edge toward a second position in which said free extremity is adjacent said second window edge, whereby when said second contact end is bent to said second position and the bus bar and the conductor are introduced to positions in superposed side-by-side engaged relation in said window opening, upon release of said second contact end, the conductor and the bus bar are biased by said second contact end toward said first window edge, thereby to maintain the conductor in electrical engagement with the bus bar; and (b) a stop member mounted within and carried solely by said contact body adjacent said intermediate portion for limiting the movement of said second contact end beyond said second position, thereby to prevent permanent deformation of the resilient contact body, said stop member being insertable within said contact body when said contact body second end portion is in its normal first position.

20. A two-part resilient connector assembly for maintaining a conductor in electrical contact with a bus bar, comprising:

(a) a generally O-shaped resilient contact body including a first end portion, an intermediate portion arranged generally at right angles to said first end portion, and a second end portion angularly arranged relative to said intermediate portion, said contact body first end portion containing a window opening having opposed first and second edges remote from and adjacent said intermediate portion, respectively, said second end portion having a free extremity and being bendable from a normal first position in which said free extremity is adjacent said first window edge toward a second position in which said free extremity is adjacent said second window edge, whereby when said second contact end is bent to said second position and the bus bar and the conductor are introduced to positions in superposed side-by-side engaged relation in said window opening, upon release of said second contact end, the conductor and the bus bar are biased by said second contact end toward said first window edge, thereby to maintain the conductor in electrical engagement with the bus bar; and (b) a stop member laterally inserted within said contact body adjacent said intermediate portion for limiting the movement of said second contact end beyond said second position, thereby to prevent permanent deformation of the resilient contact body.

21. A resilient two-part connector assembly for maintaining a conductor in electrical contact with a bus bar, comprising:

(a) a generally O-shaped resilient contact body including a first end portion, an intermediate portion arranged generally at right angles to said first end portion, and a second end portion angularly arranged relative to said intermediate portion said contact body first end portion containing a window opening having opposed first and second edges remote from and adjacent said intermediate portion, respectively, said second end portion having a free extremity and being bendable from a normal first position in which said free extremity is adjacent said first window edge toward a second position in which said free extremity is adjacent said second window edge, whereby when said second contact end is bent to said second position and the bus bar and the conductor are introduced to positions in superposed side-by-side engaged relation in said window opening, upon release of said second contact end, the conductor and the bus bar are biased by said second contact end toward said first window edge, thereby to maintain the conductor in electrical engagement with the bus bar; and (b) a stop member mounted within and carried solely by said contact body adjacent said intermediate portion for limiting the movement of said second contact end beyond said second position, thereby to prevent permanent deformation of the resilient contact body, said stop member being formed of synthetic plastic material cast in situ by injection molding within said contact body.

* * * * *